US006939234B2

(12) United States Patent
Beatty

(10) Patent No.: US 6,939,234 B2
(45) Date of Patent: Sep. 6, 2005

(54) DYNAMIC CONFIGURATION OF GAMING SYSTEM

(75) Inventor: John A. Beatty, Reno, NV (US)

(73) Assignee: WMS Gaming, Inc., Waukegan, IL (US)

( * ) Notice: Subject to any disclaimer, the term of this patent is extended or adjusted under 35 U.S.C. 154(b) by 195 days.

(21) Appl. No.: 10/165,996

(22) Filed: Jun. 10, 2002

(65) Prior Publication Data

US 2003/0232650 A1 Dec. 18, 2003

(51) Int. Cl.[7] ..... A63F 9/24

(52) U.S. Cl. ..... 463/42; 463/25; 709/221

(58) Field of Search ..... 463/12–13, 16–22, 463/25, 29, 26, 27, 40–42; 273/138.1, 138.2, 139, 143 R

(56) References Cited

U.S. PATENT DOCUMENTS

| | | | | |
|---|---|---|---|---|
| 4,652,998 | A | 3/1987 | Koza et al. | 364/412 |
| 4,842,278 | A | 6/1989 | Markowicz | 273/138 A |
| 5,276,312 | A | 1/1994 | McCarthy | 235/380 |
| 5,344,144 | A | 9/1994 | Canon | 273/138 A |
| 5,377,993 | A | 1/1995 | Josephs | 273/292 |
| 5,511,781 | A | 4/1996 | Wood et al. | 273/85 CP |
| 5,564,700 | A | 10/1996 | Celona | 463/27 |
| 5,566,337 | A | 10/1996 | Szymanski et al. | 395/733 |
| 5,626,341 | A | 5/1997 | Jones et al. | 273/292 |
| 5,762,552 | A | 6/1998 | Vuong et al. | 463/25 |
| 5,766,076 | A | 6/1998 | Pease et al. | 463/27 |
| 5,806,855 | A | 9/1998 | Cherry | 273/292 |
| 5,820,459 | A | 10/1998 | Acres et al. | 463/25 |
| 5,851,011 | A | 12/1998 | Lott | 273/292 |
| 5,855,515 | A | 1/1999 | Pease et al. | 463/27 |
| 5,885,158 | A | 3/1999 | Torango et al. | 463/27 |
| 5,941,773 | A | 8/1999 | Harlick | 463/26 |
| 5,947,822 | A | 9/1999 | Weiss | 463/13 |
| 5,951,011 | A | 9/1999 | Potter et al. | 273/292 |
| 6,241,608 | B1 | 6/2001 | Torango | 463/27 |
| 6,254,483 | B1 | 7/2001 | Acres | 463/26 |
| 6,319,125 | B1 * | 11/2001 | Acres | 463/25 |
| 6,358,150 | B1 | 3/2002 | Mir et al. | 463/28 |
| 6,383,074 | B1 | 5/2002 | Boggs | 463/25 |
| 2001/0036857 | A1 | 11/2001 | Mothwurf et al. | 463/25 |

FOREIGN PATENT DOCUMENTS

| | | | |
|---|---|---|---|
| GB | 2 378 664 A | 2/2003 | A63F/3/00 |
| WO | WO 03/045518 A1 | 6/2003 | A63F/13/00 |

* cited by examiner

*Primary Examiner*—Mark Sager
(74) *Attorney, Agent, or Firm*—Jenkens & Gilchrist

(57) ABSTRACT

A gaming system comprises a plurality of common objects, a plurality of application objects, and a central system. The common objects are shared by a plurality of applications and include gaming devices and games. Each gaming device includes at least one of the games. The application objects are used in one of the applications. The central system is linked to the gaming devices and includes a common database and an application database. The common database defines the common objects and first associations between the common objects. The application database defines the application objects, second associations between the application objects, and third associations between the common objects and the application objects. The central system is adapted to dynamically configure the one of the applications based on a change to one or more of the first, second, and third associations.

20 Claims, 1 Drawing Sheet

DYNAMIC CONFIGURATION OF GAMING SYSTEM

FIELD OF THE INVENTION

The present invention relates generally to gaming systems and, more particularly, to dynamic configuration of features offered on a gaming system that links gaming devices.

BACKGROUND OF THE INVENTION

In the gaming industry, a "progressive" involves the collecting of coin-in data from participating gaming devices (e.g., slot machines), contributing a percentage of that coin-in data to a jackpot amount, and awarding that jackpot amount to a player upon a jackpot won event. A jackpot won event typically occurs when a "progressive winning position" is achieved at a participating gaming device. If the gaming device is a slot machine, a progressive winning position may, for example, correspond to alignment of progressive jackpot reel symbols along a certain pay line.

Historically, progressive gaming systems have utilized single-purpose progressive game chips, able to behave as progressive games only. A game is internally configured to behave as a progressive. Unfortunately, without separating the progressive definition from the game, the game cannot quickly and easily participate in any other progressive other than the one for which it is currently configured. Also, without the capacity to enable and disable progressive behavior in a game, stopping and starting a progressive during a jackpot session is impossible without physical intervention.

Historically, gaming applications such as progressive gaming systems which require physical objects (e.g., gaming devices, site controllers, carousel controllers, etc.) have used their own definitions of these physical objects instead of using shared definitions from a common source (e.g., central system). Unfortunately, without a common source of definitions of physical objects, maintaining multiple sources of definitions requires added administration and is prone to errors of omission and incongruity. Also, without the separate profiling of physical objects by physical attributes and application attributes, adding or removing games and gaming devices from an application, such as a progressive session, requires physical intervention to each individual device.

A need therefore exists for a gaming system that overcomes one or more of the aforementioned shortcomings.

SUMMARY OF THE INVENTION

A gaming system comprises a plurality of common objects, a plurality of application objects, and a central system. The common objects are shared by a plurality of applications and include gaming devices and games. Each gaming device includes at least one of the games. The application objects are used in one of the applications. The central system is linked to the gaming devices and includes a common database and an application database. The common database defines the common objects and first associations between the common objects. The application database defines the application objects, second associations between the application objects, and third associations between the common objects and the application objects. The central system is adapted to dynamically configure the one of the applications based on a change to one or more of the first, second, and third associations.

BRIEF DESCRIPTION OF THE DRAWINGS

The foregoing and other advantages of the invention will become apparent upon reading the following detailed description and upon reference to the drawings.

Figure 1:
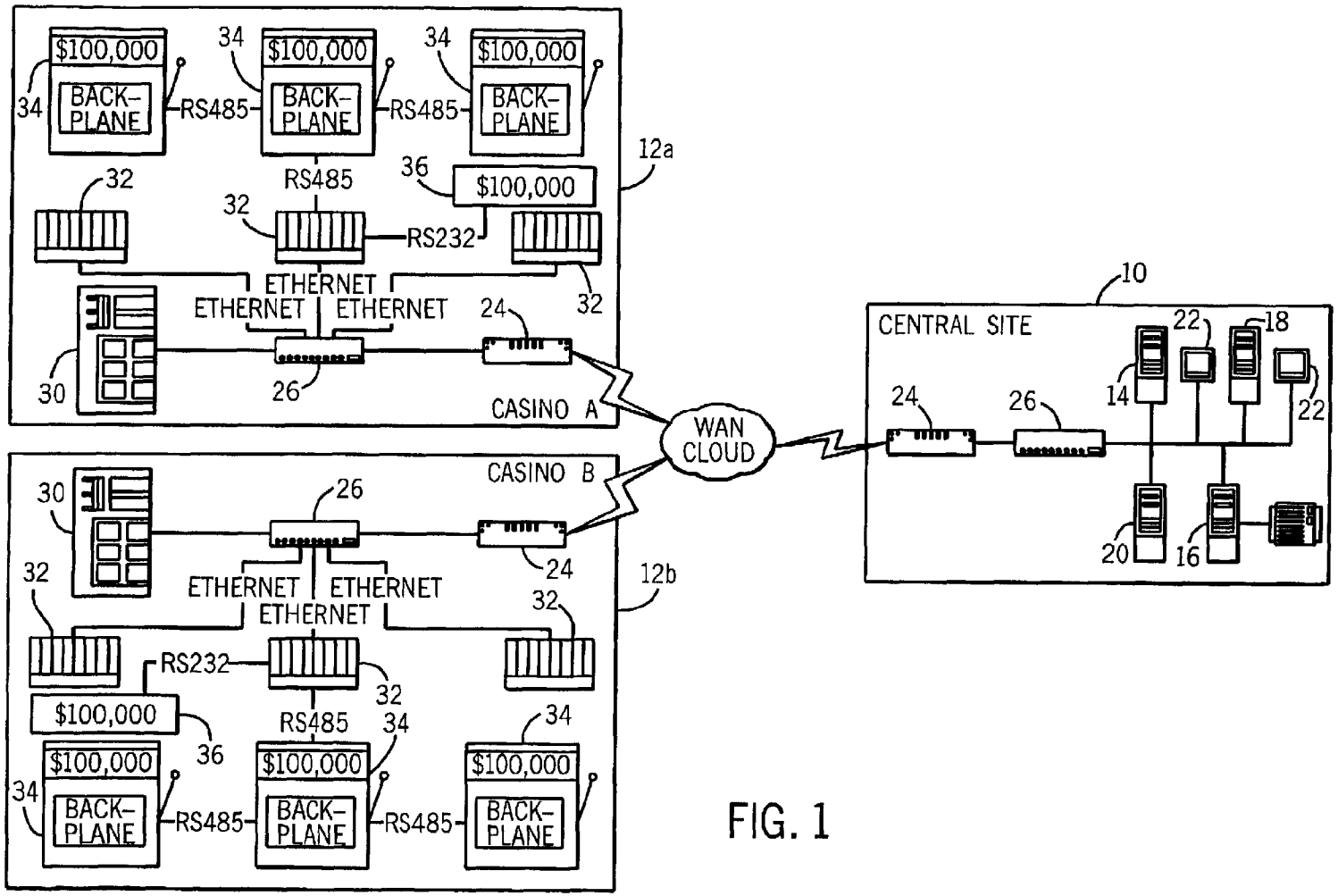
FIG. 1 is a block diagram of a wide area progressive gaming system embodying the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

The present invention provides a system and method for dynamically creating, configuring, and controlling gaming system features through the use of database processing. By way of example, the present invention is described in the context of progressives; however, the present invention may be implemented with other gaming system features such as player tracking, tournaments, team play, and a variety of promotional bonuses (e.g., multiple jackpot bonuses, mystery jackpot bonuses, player-specific bonuses, etc.).

As noted above, a "progressive" involves the collecting of coin-in data from participating gaming devices, contributing a percentage of that coin-in data to a jackpot amount, and awarding that jackpot amount to a player upon a jackpot won event. Progressives may include parameters describing which gaming devices will participate, which players will participate, a time frame in which a jackpot could be awarded, a subscriber list of guaranteed winning locations, a set of rules defining the jackpot won event, etc. A progressive gaming system can simultaneously run multiple progressives associated with respective jackpots. As described in detail below, each progressive and respective jackpot has database supplied unique identifiers.

Turning now to the drawings, FIG. 1 is an overview schematic of hardware components of a wide area progressive (WAP) gaming system. The progressive gaming system is operable over a central site 10 and a plurality of remote casino sites 12. The central site 10 is an operations center for the progressive gaming system and its associated progressives. The central site 10 contains a central system, which is the hardware and software that runs the progressive gaming system. Data processing functions of the central system include all device configuration, meter accumulation and reporting, and jackpot verification and reporting.

The central system includes four servers fulfilling the following functions: middle tier application server 14, database server 16, communications server 18, and standby/backup server 20. Additional hardware may include a pair of user interface/monitoring stations 22 and a couple of printers (not shown). The middle tier application server 14 includes a group of software applications that are responsible for processing business rules and handling communications between devices. The database server 16 collects historical data and stores the data for reporting purposes, as well as processing certain business rules. The communications server 18 is a middle tier server that manages network communications between the remote sites 12 and the central site 10. The standby server 20 is a fault tolerant server that maintains a copy of the transaction log from an SQL Server. A stored procedure processes this activity. The standby server 20 also provides fault tolerance for active directory, DNS, and DHCP services. Each of the user interfaces 22 is a collection of central system applications that provide reporting and configuration capability and provide progressive data feedback to a trained computer operator who monitors the central system hardware and software 24 hours per day and 7 days per week.

The remote sites 12 each include a site controller 30, a plurality of carousel controllers 32, and a carousel of gaming devices 34 and overhead display 36 linked to each carousel controller 32. A carousel is a collection or bank of gaming devices 34 in close physical proximity to each other. These gaming devices are connected to an associated carousel controller 32. The carousel controller 32 is an embedded board processor that acts as a gaming device data collector and message requester. The gaming devices 34 in the carousel communicate to the associated carousel controller 32 as they are polled by the carousel controller 32. In addition, the gaming devices 34 may initiate messages to the associated carousel controller 32. The carousel controller 32 then reports the data for its carousel of gaming devices 34 to the site controller 30 at the same remote site 12. Each overhead display 36 may, for example, be an LED display device for depicting a progressive jackpot amount as it grows through progressive play. The overhead display 36 connects to the respective carousel controller 32, and acts as a display-only device to advertise the progressive jackpot amount(s) available for award. Data processing functions of the carousel controller 32 include game, gaming device, and display configuration assignment and validation.

The site controller 30 includes a processor that acts as a data collector and message requester for a remote site 12, such as a casino, and communicates that information back to the central system at the central site 10. Typically, all of the carousel controllers 32 at one remote site 12 will report to a single site controller 30, which will then report the remote site's data across a wide area connection (e.g., phone line) to the central system. Data processing functions of the site controller 30 include carousel controller configuration assignment and validation. In an alternative embodiment, the site controller 30 is linked directly to the gaming devices 34 at the same remote site 12 without any carousel controllers 32 serving as intermediaries.

Each gaming device 34 is a physical object that contains one or more games. These include mechanical-reel slot machines, video-display slot machines, video lottery terminals, etc. Gaming devices 34 may be logically grouped by type, physical location, manufacturer, etc. A "game" is either a physical piece of equipment containing software that may be manually inserted into a gaming device 34, or a software program that might be electronically added to a software package within a gaming device 34. A game contains the logic necessary for an individual instance of play. Games may be logically grouped by type, theme, manufacturer, etc. Games may be non-wagering games or wagering games such as slots, poker, keno, bingo, roulette, and blackjack.

The progressive gaming system enables the multiple gaming devices 34 in the multiple remote sites 12 to contribute to and compete for one or more system wide jackpots. The number of progressives and the attributes of each progressive (such as progression rate) are configured in the central system. Each participating gaming device 34 is configured by the carousel controller's progressive configuration definitions which are supplied by the central system. Each game defined to participate in a progressive within a gaming device is notified to transmit a jackpot won event upon the occurrence of a certain incident, such as a specific slot reel alignment.

The central system collects information and data from the multiple gaming devices 34 in the multiple remote sites 12. When a gaming device 34 is enabled to play, the gaming device 34 sends meter and event data to the central system. The data collected by the central system includes coin-in and other meter information, exception and regulatory reporting information, jackpot won information, and system statistics. The central system also calculates and distributes the progressive prize amount throughout the progressive gaming system. An extensible message protocol between the central system and the gaming devices 34 ensures that the central system can support a full range of gaming devices 34.

The hardware components in FIG. 1 are linked together to complete the progressive gaming system. Each gaming device 34 is linked to the central system via, for example, a serial line interface to its carousel controller 32. Other interfaces may be suitable as well. Each carousel controller 32 connects to its carousel of gaming devices and to its overhead display 36. Each carousel controller 32 is connected via, for example, an Ethernet TCP/IP interface to the site controller 30 at the same remote site 12. The carousel controllers 32 and the site controllers 30 both provide for local data storage and accumulation of progressive information in the event of a disruption in the wide area network or local area network. To allow the central system and the site controllers 30 to communicate over the wide area network, the central site 10 and the remote sites 12 each include a respective gateway that serves as an entrance to the wide area network. The gateway is associated with both a standard network router 24, which knows where to direct a given packet of data that arrives at the gateway, and a switch 26, which furnishes the actual path in and out of the gateway for a given packet. The various computers in the central system are linked together via, for example, an Ethernet LAN. The central system computers share communications, data processing, business rule processing and reporting functions.

Each time a patron places a bet on a participating gaming device 34, the life-to-date coin-in meter of the gaming device 34 is sent to the central system. The central system calculates the bet meter delta and a new progressive prize amount. The central system periodically transmits the new progressive prize amount update to all gaming devices 34 and overhead displays 36 on the progressive. The displays 36 then scroll to the current progressive amount. Only the life-to-date coin-in meter is required and collected for the proper function of the progressive gaming system. However, the system may also collect additional meters for the purpose of game performance reporting. Additional meters are collected upon initiation and periodically for each gaming device 34.

The top-level progressive jackpot is awarded in response to a "jackpot won event." There are two types of jackpot won events. The first type of jackpot won event is game-enabled, which occurs when a "progressive winning position" is achieved at a participating gaming device 34. A progressive winning position is a module within a game's software code that responds with a jackpot won event when certain game-level conditions are met, such as a winning reel position on a slot machine. Only one progressive may be assigned to a progressive winning position at a time. This position has a single winning percentage. At the time the progressive winning position occurs at a gaming device 34, the winning gaming device 34 is disabled from play and immediately transmits the jackpot won event to the central system. The central system calculates a final prize amount and transmits this amount to the winning gaming device 34 and to all display devices 36 on the same progressive.

The second type of jackpot won event is central system-enabled. A progressive winning position is not used to generate a jackpot won event when a progressive awards a jackpot using a central system-enabled jackpot won event. An example may be a message sent from the central system to the next gaming device 34 that places a wager.

The central system monitors certain events and error conditions at each gaming device 34 in order to (1) ensure maximum available time for play of the gaming device 34 and (2) monitor evidence of tampering. Monitored events include opening of gaming device doors, coin-in errors, reel spin errors, and device communication errors. Each time such an event occurs at the gaming device 34 (or other system device) a message is sent to the central system and displayed on a line printer at the central site 10. The central site is monitored, via the user interfaces 22, 24 hours per day and 7 days per week. Each time an event is reported at the central site 10, a trained computer operator reviews the event and responds appropriately.

The central system provides substantial accounting, game performance, and reporting functions. Information regarding progressive prizes is reported by the central system. The following are examples of reports provided regarding progressive prize information: detailed prize information, prize information for a specific period, and prize information for specific casinos. Coin-in information for all gaming devices 34 on the progressive gaming system is retained at the central system. The following are examples of reports provided regarding coin-in information: coin-in by device by progressive jackpot, coin-in by device by day, and daily billing reports. Coin-in information is also used to develop performance reporting for gaming devices 34 on the progressive gaming system. The following are examples of reports provided regarding game performance: theoretical win by gaming device, theoretical win by casino, and theoretical win by game. The progressive gaming system also provides reporting on system events. The following are examples of reports provided regarding system events: device exception reports and system audit reports. Finally, while not required for progressive operation, the system may also provide data collection for additional performance reporting. Additional meters (e.g., drop and games played) are collected from all gaming devices 34 and stored in the central system.

In accordance with the present invention, the central system is capable of creating, configuring, and controlling multiple progressives. Toward that end, the central system defines progressive game sets. A "progressive game set" is a grouping of games that can be assigned as a set to one or more progressives. When a jackpot won event is game-enabled, each game in a progressive game set contains the same progressive winning position. This means that the same odds of winning occur at the same progressive winning position within each game in a progressive game set. When a jackpot won event is central system-enabled, the progressive winning position is unimportant. Each progressive game set has a database supplied unique identifier.

By way of example, the following tables represent progressive game sets. The assignable progressive winning positions are emphasized with italics.

| Progressive Game Set 1 | | | | | |
|---|---|---|---|---|---|
| Progressive Winning Position | Odds | Progressive Winning Position | Odds | Progressive Winning Position | Odds |
| Game 1 | | Game 2 | | Game 3 | |
| 1 | A | 1 | A | 1 | A |
| **Progressive Game Set 2** | | | | | |
| Game 4 | | Game 5 | | Game 6 | |
| 1 | A | 1 | A | 1 | A |
| 2 | B | 2 | B | 2 | B |
| 3 | C | 3 | C | 3 | C |
| **Progressive Game Set 3** | | | | | |
| Game 7 | | Game 8 | | Game 9 | |
| 1 | A | 1 | C | 1 | X |
| 2 | B | 2 | B | 2 | B |
| 3 | C | 3 | A | 3 | Z |
| **Progressive Game Set 4** | | | | | |
| Game 10 | | Game 11 | | Game 12 | |
| 1 | B | 1 | B | 1 | B |
| 2 | A | 2 | A | 2 | A |

A progressive may, for example, contain the following: (a) Game Set 2—Progressive Winning Position 2 (odds B); (b) Game Set 3—Progressive Winning Position 2 (odds B); and (c) Game Set 4—Progressive Winning Position 1 (odds B).

To allow the central system to create, configure, and control multiple progressives, the central system (e.g., database server 16) supplies unique identifiers to various entities in the progressive gaming system. The various entities range from the largest entity in the progressive gaming system's physical world to the smallest, or atomic, entity in the system's physical world. The entities may, for example, include the remote sites 12, the site controllers 30, the carousel controllers 32, the gaming devices 34, the games, progressive game sets, progressives, and progressive winning positions. Each entity in the progressive gaming system is identified by a database supplied unique identifier (e.g., ID number).

The entities include common objects and application objects. "Common" objects are "physical" objects that are shared by various "applications." The common objects are grouped in a common database at the central system. "Physical" objects are touchable objects that require configuration settings representing the object's current status in the physical world. Physical objects have a physical profile that is independent of all "applications." "Application" objects are un-shared physical objects, and associations between the application and both common and un-shared physical objects. "Applications" generate application profiles that are also given to the physical objects.

In the context of a wide area progressive gaming system, application objects and application profiles are also known as progressive objects and progressive profiles, respectively. Examples of common objects in the system include the remote sites 12, the site controllers 30, the carousel controllers 32, the gaming devices 34, and the games installed in the gaming devices 34. Examples of configuration settings for a gaming device 34, for example, include SiteID, SiteControllerID, CarouselControllerID, ManufacturerNumber, ManufacturerID, associated TopBoxID (if one exists), etc. Examples of progressive objects include progressive game sets, progressives, and progressive winning positions. An example of a progressive object association for a particular game is an associated ProgressiveGameSetId, which, in turn, has a ProgressiveWinningPosition and ProgressiveID. By way of example, the common objects and their associations may appear in central system database tables as follows:

Site

| SiteID | SiteName |
|---|---|
| 1 | Billy Budd's |
| 2 | Frankie & Johnny's |

SiteController

| SiteControllerID | SiteID |
|---|---|
| 1 | 1 |
| 2 | 2 |

CarouselController

| CarouselControllerID | SiteControllerID |
|---|---|
| 1 | 1 |
| 2 | 2 |

GamingDevice

| GamingDeviceID | SiteID | CarouselControllerID |
|---|---|---|
| 1 | 1 | 1 |
| 2 | 1 | 1 |
| 3 | 1 | 1 |
| 4 | 1 | 1 |
| 5 | 1 | 1 |
| 6 | 1 | 1 |
| 7 | 1 | 1 |
| 8 | 1 | 1 |
| 9 | 2 | 2 |

Game

| GameID | CountProgressiveWinningPosition |
|---|---|
| 1 | 4 |
| 2 | 4 |
| 3 | 4 |
| 4 | 4 |

GamingDevice_Game

| GamingDeviceID | GameID |
|---|---|
| 1 | 1 |
| 2 | 1 |
| 3 | 2 |
| 4 | 2 |
| 5 | 3 |
| 6 | 3 |
| 7 | 4 |
| 8 | 4 |
| 9 | 3 |
| 9 | 4 |

Similarly, the progressive objects and their associations may appear in central stem database tables as follows:

ProgressiveGameSet

| ProgressiveGameSetID |
|---|
| 1 |
| 2 |
| 3 |

ProgressiveGameSet_Game

| ProgressiveGameSetID | GameID |
|---|---|
| 1 | 1 |
| 1 | 2 |
| 2 | 3 |
| 3 | 4 |

Progressive

| ProgressiveID | IsActive |
|---|---|
| 1 | 1 |
| 2 | 1 |

Progressive_ProgressiveGameSet

| ProgressiveID | ProgressiveGameSetID | ProgressiveWinningPosition |
|---|---|---|
| 1 | 1 | 1 |
| 2 | 1 | 2 |
| 2 | 2 | 1 |

Progressive_GamingDevice_Game

| ProgressiveID | GamingDeviceID | GameID | ProgressiveWinningPosition | IsEnrolled |
|---|---|---|---|---|
| 1 | 1 | 1 | 1 | 1 |
| 1 | 2 | 1 | 1 | 1 |

-continued

| | | | | |
|---|---|---|---|---|
| 1 | 3 | 2 | 1 | 1 |
| 1 | 4 | 2 | 1 | 1 |
| 2 | 1 | 1 | 2 | 1 |
| 2 | 2 | 1 | 2 | 1 |
| 2 | 3 | 2 | 2 | 1 |
| 2 | 4 | 2 | 2 | 1 |
| 2 | 5 | 3 | 1 | 1 |
| 2 | 6 | 3 | 1 | 1 |
| 2 | 9 | 3 | 1 | 1 |

The above database tables yield the following organization of entities:

```
Site 1
    SiteController 1
        CarouselController 1
            GamingDevice 1
                Game 1
                    ProgressiveGameSet 1
                        Progressive 1
                            ProgressiveWinningPosition 1
                        Progressive 2
                            ProgressiveWinningPosition 2
            GamingDevice 2
                Game 1
                    ProgressiveGameSet 1
                        Progressive 1
                            ProgressiveWinningPosition 1
                        Progressive 2
                            ProgressiveWinningPosition 2
            GamingDevice 3
                Game 2
                    ProgressiveGameSet 1
                        Progressive 1
                            ProgressiveWinningPosition 1
                        Progressive 2
                            ProgressiveWinningPosition 2
            GamingDevice 4
                Game 2
                    ProgressiveGameSet 1
                        Progressive 1
                            ProgressiveWinningPosition 1
                        Progressive 2
                            ProgressiveWinningPosition 2
            GamingDevice 5
                Game 3
                    ProgressiveGameSet 2
                        Progressive 2
                            ProgressiveWinningPosition 1
            GamingDevice 6
                Game 3
                    ProgressiveGameSet 2
                        Progressive 2
                            ProgressiveWinningPosition 1
            GamingDevice 7
                Game 4
            GamingDevice 8
                Game 4
Site 2
    SiteController 2
        CarouselController 2
            GamingDevice 9
                Game 3
                    ProgressiveGameSet 2
                        Progressive 2
                            ProgressiveWinningPosition 1
                Game 4
```

The following examples demonstrate how the central system can create, configure, and control multiple progressives and how the database tables dynamically reflect configuration changes made to the progressives. As the central system creates, configures, and controls multiple progressives, the central system sends updated progressive profiles to any affected carousel controllers. The database schema in the central system may be designed with sufficient flexibility to handle complex progressive configurations. The first two examples represent the two types of jackpot won events that may occur within a progressive: (1) a jackpot won event enabled from a game installed in a gaming device 34 and (2) a jackpot won event enabled from the central system. In the examples, primary key columns are shown with an underline.

EXAMPLE 1

Creating a Progressive with a Game-Enabled Jackpot Won Event

Each game capable of play in a progressive with game-enabled jackpot won events will contain at least one progressive winning position. It is at the central system (e.g., at the database server 16), not in the game, that the association between progressive winning position and progressive is made. This will allow the same game installed in different gaming devices to participate in different progressives. For example, if all games in ProgressiveGameSetID 1 are playing in a progressive at SiteID 1, there may also be games from ProgressiveGameSetID 1 playing in a different progressive at the same or another site. Naturally, if there is more than one progressive winning position in a game, multiple progressives may be assigned to that game.

The central system is able to assign a progressive to the smallest, or atomic, entity in the progressive gaming system's physical world. This atomic entity, also known as a "progressive unit," is a progressive winning position within a game within a gaming device. The progressive winning position initiates a jackpot won event and therefore has an association to a progressive.

In this first example, the progressive configuration parameters are:

include games in ProgressiveGameSetID's 2 and 3;

assign Progressive Winning Position 3 in all games to the progressive; and include all appropriate games in all gaming devices at SiteID 1.

In the Progressive object table below, the new progressive (e.g., ProgressiveID 3) is assigned an ID number.

Progressive

| ProgressiveID | IsActive |
|---|---|
| 1 | 1 |
| 2 | 1 |
| 3 | 0 |

In the GamingDevice object table below, possible candidates for the above progressive are emphasized with italics. The possible candidates are members of SiteID 1.

GamingDevice

| GamingDeviceID | SiteID | CarouselControllerID |
|---|---|---|
| 1 | 1 | 1 |
| 2 | 1 | 1 |

-continued

GamingDevice

| GamingDeviceID | SiteID | CarouselControllerID |
|---|---|---|
| 3 | 1 | 1 |
| 4 | 1 | 1 |
| 5 | 1 | 1 |
| 6 | 1 | 1 |
| 7 | 1 | 1 |
| 8 | 1 | 1 |
| 9 | 2 | 2 |

In the ProgressiveGameSet_Game object table below, possible candidates for the above progressive are emphasized with italics. The possible candidates are members of ProgressiveGameSetID's 2 and 3.

ProgressiveGameSet_Game

| ProgressiveGameSetID | GameID |
|---|---|
| 1 | 1 |
| 1 | 2 |
| 2 | 3 |
| 3 | 4 |

In the GamingDevice_Game object table below, possible candidates for the above progressive are emphasized with italics. The possible candidates are gaming devices at SiteID 1 with games from ProgressiveGameSetID's 2 and 3.

GamingDevice_Game

| GamingDeviceID | GameID |
|---|---|
| 1 | 1 |
| 2 | 1 |
| 3 | 2 |
| 4 | 2 |
| 5 | 3 |
| 6 | 3 |
| 7 | 4 |
| 8 | 4 |
| 9 | 3 |
| 9 | 4 |

The Progressive GamingDevice_Game object table below emphasizes with italics the rows created according to the new progressive configuration parameters.

| Progressive_GamingDevice_Game | | | | |
|---|---|---|---|---|
| ProgressiveID | GamingDeviceID | GameID | ProgressiveWinningPosition | IsEnrolled |
| 1 | 1 | 1 | 1 | 1 |
| 1 | 2 | 1 | 1 | 1 |
| 1 | 3 | 2 | 1 | 1 |
| 1 | 4 | 2 | 1 | 1 |
| 2 | 1 | 1 | 2 | 1 |
| 2 | 2 | 1 | 2 | 1 |
| 2 | 3 | 2 | 2 | 1 |
| 2 | 4 | 2 | 2 | 1 |
| 2 | 5 | 3 | 1 | 1 |
| 2 | 6 | 3 | 1 | 1 |
| 2 | 9 | 3 | 1 | 1 |
| 3 | 5 | 3 | 3 | 1 |
| 3 | 6 | 3 | 3 | 1 |
| 3 | 7 | 4 | 3 | 1 |
| 3 | 8 | 4 | 3 | 1 |

With the present invention, it should be noted that it is possible to create additional progressives to include gaming devices/game entities already participating in existing progressives. For example, if another new ProgressiveID 4 including Progressive Winning Position 4 for all GameID 3's in the system (regardless of site) is created, the above table would then include additional rows for GameID 3 in GamingDeviceID 5, GameID 3 in GamingDeviceID6, and GameID3 in GamingDeviceID 9.

EXAMPLE 2

Creating a Progressive with a Central System-Enabled Jackpot Won Event

Games participating in a progressive with central system-enabled jackpot won events require no assignment of a progressive winning position. It is at the central system, not in the game, that the jackpot won event is initiated.

In this example, the progressive configuration parameters are:

| Progressive_GamingDevice_Game | | | | |
|---|---|---|---|---|
| ProgressiveID | GamingDeviceID | GameID | ProgressiveWinningPosition | IsEnrolled |
| 1 | 1 | 1 | 1 | 1 |
| 1 | 2 | 1 | 1 | 1 |
| 1 | 3 | 2 | 1 | 1 |
| 1 | 4 | 2 | 1 | 1 |
| 2 | 1 | 1 | 2 | 1 |
| 2 | 2 | 1 | 2 | 1 |
| 2 | 3 | 2 | 2 | 1 |
| 2 | 4 | 2 | 2 | 1 |
| 2 | 5 | 3 | 1 | 1 |
| 2 | 6 | 3 | 1 | 1 |
| 2 | 9 | 3 | 1 | 1 |
| 3 | 5 | 3 | 3 | 1 |
| 3 | 6 | 3 | 3 | 1 |
| 3 | 7 | 4 | 3 | 1 |
| 3 | 8 | 4 | 3 | 1 |
| 4 | 5 | 3 | 4 | 1 |
| 4 | 6 | 3 | 4 | 1 |
| 4 | 9 | 3 | 4 | 1 |

Staying with this first example, the central system has properly configured the progressive and transferred specific data to each participating site controller in the progressive gaming system. The data is separated once more and sent to each participating carousel controller. The carousel controller, in turn, notifies each gaming device to turn on progressive play for each specified progressive winning position within each specified game. The gaming device/game entity now knows it is participating in a progressive, and that a certain progressive winning position within that game will generate a jackpot won event when a jackpot is hit. The carousel controller has the configuration knowledge specifying which progressive is associated with which gaming device/game entity. In other words, the gaming device/game entity knows it is participating in a progressive, and the carousel controller knows which one.

include games from ProgressiveGameSetID 3; and include all gaming devices.

In the progressive object table below, the progressive is assigned an ID number.

| Progressive | |
|---|---|
| ProgressiveID | IsActive |
| 1 | 1 |
| 2 | 1 |
| 3 | 1 |

-continued

| Progressive | |
|---|---|
| ProgressiveID | IsActive |
| 4 | 1 |
| 5 | 0 |

In the GamingDevice object table below, possible candidates for the above progressive are emphasized with italics. The possible candidates are all gaming devices.

| GamingDevice | | |
|---|---|---|
| GamingDeviceID | SiteID | CarouselControllerID |
| 1 | 1 | 1 |
| 2 | 1 | 1 |
| 3 | 1 | 1 |
| 4 | 1 | 1 |
| 5 | 1 | 1 |
| 6 | 1 | 1 |
| 7 | 1 | 1 |
| 8 | 1 | 1 |
| 9 | 2 | 2 |

In the ProgressiveGameSet_Game object table below, possible candidates for the above progressive are emphasized with italics. The possible candidates are members of ProgressiveGameSetID 3.

| ProgressiveGameSet_Game | |
|---|---|
| ProgressiveGameSetID | GameID |
| 1 | 1 |
| 1 | 2 |

-continued

| ProgressiveGameSet_Game | |
|---|---|
| ProgressiveGameSetID | GameID |
| 2 | 3 |
| 3 | 4 |

The GamingDevice_Game object table below shows gaming device/game entitles that exist in the progressive gaming system. Possible candidates for the above progressive are emphasized with italics. The possible candidates are gaming devices with games from ProgressiveGameSetID 3.

| GamingDevice_Game | |
|---|---|
| GamingDeviceID | GameID |
| 1 | 1 |
| 2 | 1 |
| 3 | 2 |
| 4 | 2 |
| 5 | 3 |
| 6 | 3 |
| 7 | 4 |
| 8 | 4 |
| 9 | 3 |
| 9 | 4 |

The Progressive_GamingDevice_Game object table below emphasizes with italics the rows created according to the new progressive configuration parameters.

| Progressive_GamingDevice_Game | | | | |
|---|---|---|---|---|
| ProgressiveID | GamingDeviceID | GameID | ProgressiveWinningPosition | IsEnrolled |
| 1 | 1 | 1 | 1 | 1 |
| 1 | 2 | 1 | 1 | 1 |
| 1 | 3 | 2 | 1 | 1 |
| 1 | 4 | 2 | 1 | 1 |
| 2 | 1 | 1 | 2 | 1 |
| 2 | 2 | 1 | 2 | 1 |
| 2 | 3 | 2 | 2 | 1 |
| 2 | 4 | 2 | 2 | 1 |
| 2 | 5 | 3 | 1 | 1 |
| 2 | 6 | 3 | 1 | 1 |
| 2 | 9 | 3 | 1 | 1 |
| 3 | 5 | 3 | 3 | 1 |
| 3 | 6 | 3 | 3 | 1 |
| 3 | 7 | 4 | 3 | 1 |
| 3 | 8 | 4 | 3 | 1 |
| 4 | 5 | 3 | 4 | 1 |
| 4 | 6 | 3 | 4 | 1 |
| 4 | 9 | 3 | 4 | 1 |
| 5 | 7 | 4 | 0 | 1 |
| 5 | 8 | 4 | 0 | 1 |
| 5 | 9 | 4 | 0 | 1 |

When a jackpot won event occurs at the central system, the central system informs a site controller. The site controller then informs a carousel controller, which in turn informs a winning gaming device that a jackpot award has been won. Because of the transactional nature of a jackpot won event, acknowledgement from the gaming device is necessary before the jackpot won event is considered complete. Therefore, the winning gaming device sends a response back to the central system acknowledging that the gaming device received notification that it won the jackpot

EXAMPLE 3

Turning Off a Progressive

The central system can change an existing progressive configuration if desired. The central system notifies any affected carousel controllers of a change in the existing progressive configuration, and each affected carousel controller in turn notifies the gaming devices that are in its control of the updated progressive status. For example, the central system may deactivate or turn "off" an existing progressive such as ProgressiveID 2 in the above examples. To deactivate an existing progressive, the central system must notify all previously defined games within the gaming devices that are participating in the progressive that they are no longer participating The following table shows the current progressive profile used by CarouselControllerID 1 prior to making ProgressiveID 2 inactive:

Progressive Profile for ControllerID1

| Site Controller ID | Carousel Controller ID | LastCCProgressive ProfileChange | Gaming Device ID | Game ID | Progressive Winning Position | Progressive ID |
|---|---|---|---|---|---|---|
| 1 | 1 | 2002-04-10 13:48:41.403 | 1 | 1 | 1 | 1 |
| 1 | 1 | 2002-04-10 13:48:41.403 | 2 | 1 | 1 | 1 |
| 1 | 1 | 2002-04-10 13:48:41.403 | 3 | 2 | 1 | 1 |
| 1 | 1 | 2002-04-10 13:48:41.403 | 4 | 2 | 1 | 1 |
| 1 | 1 | 2002-04-10 13:48:41.403 | 1 | 1 | 2 | 2 |
| 1 | 1 | 2002-04-10 13.48:41.403 | 2 | 1 | 2 | 2 |
| 1 | 1 | 2002-04-10 13:48:41.403 | 3 | 2 | 2 | 2 |
| 1 | 1 | 2002-04-10 13:48:41.403 | 4 | 2 | 2 | 2 |
| 1 | 1 | 2002-04-10 13:48:41.403 | 5 | 3 | 1 | 2 |
| 1 | 1 | 2002-04-10 13:48:41.403 | 6 | 3 | 1 | 2 |
| 1 | 1 | 2002-04-10 13:48:41.403 | 5 | 3 | 3 | 3 |
| 1 | 1 | 2002-04-10 13:48:41.403 | 6 | 3 | 3 | 3 |
| 1 | 1 | 2002-04-10 13:48:41.403 | 7 | 4 | 3 | 3 |
| 1 | 1 | 2002-04-10 13:48:41.403 | 8 | 4 | 3 | 3 |
| 1 | 1 | 2002-04-10 13:48:41.403 | 5 | 3 | 4 | 4 |
| 1 | 1 | 2002-04-10 13:48:41.403 | 6 | 3 | 4 | 4 |
| 1 | 1 | 2002-04-10 13:48:41.403 | 7 | 4 | 0 | 5 |
| 1 | 1 | 2002-04-10 13:48:41.403 | 8 | 4 | 0 | 5 |

The following table shows the current progressive profile used by CarouselControllerID 2 prior to making ProgressiveID 2 inactive:

Progressive Profile for ControllerID2

| Site Controller ID | Carousel Controller ID | LastCCProgressive ProfileChange | Gaming Device ID | Game ID | Progressive Winning Position | Progressive ID |
|---|---|---|---|---|---|---|
| 2 | 2 | 2002-04-10 13:48:41.403 | 9 | 3 | 1 | 2 |
| 2 | 2 | 2002-04-10 13:48:41.403 | 9 | 3 | 4 | 4 |
| 2 | 2 | 2002-04-10 13:48:41.403 | 9 | 4 | 0 | 5 |

The following ProgressiveID 2 is deactivated, the Progressive object table shows ProgressiveID 2 to be inactive.

Progressive

| ProgressiveID | IsActive |
|---|---|
| 1 | 1 |
| 2 | 0 |
| 3 | 1 |
| 4 | 1 |
| 5 | 1 |

The central system sends an updated progressive profile to any affected carousel controllers (i.e., CarouselControllerID's 1 and 2), which in turn notify the gaming devices in their respective control. The updated progressive profile is accompanied by the date and time of the progressive profile change. The following table shows the updated progressive profile sent to CarouselControllerID 1 after making ProgressiveID 2 inactive:

Progressive Profile for ControllerID1

| Site Controller ID | Carousel Controller ID | LastCCProgressive ProfileChange | Gaming Device ID | Game ID | Progressive Winning Position | Progressive ID |
|---|---|---|---|---|---|---|
| 1 | 1 | 2002-04-15 10:13:06.413 | 1 | 1 | 1 | 1 |
| 1 | 1 | 2002-04-15 10:13:06.413 | 2 | 1 | 1 | 1 |
| 1 | 1 | 2002-04-15 10:13:06.413 | 3 | 2 | 1 | 1 |
| 1 | 1 | 2002-04-15 10:13:06.413 | 4 | 2 | 1 | 1 |
| 1 | 1 | 2002-04-15 10:13:06.413 | 5 | 3 | 3 | 3 |
| 1 | 1 | 2002-04-15 10:13:06.413 | 6 | 3 | 3 | 3 |
| 1 | 1 | 2002-04-15 10:13:06.413 | 7 | 4 | 3 | 3 |
| 1 | 1 | 2002-04-15 10:13:06.413 | 8 | 4 | 3 | 3 |
| 1 | 1 | 2002-04-15 10:13:06.413 | 5 | 3 | 4 | 4 |
| 1 | 1 | 2002-04-15 10:13:06.413 | 6 | 3 | 4 | 4 |
| 1 | 1 | 2002-04-15 10:13:06.413 | 7 | 4 | 0 | 5 |
| 1 | 1 | 2002-04-15 10:13:06.413 | 8 | 4 | 0 | 5 |

The following table shows the updated progressive profile sent to CarouselControllerID 2 after making ProgressiveID2 inactive:

Progressive Profile for ControllerID2

| Site Controller ID | Carousel Controller ID | LastCCProgressive ProfileChange | Gaming Device ID | Game ID | Progressive Winning Position | Progressive ID |
|---|---|---|---|---|---|---|
| 2 | 2 | 2002-04-15 10:13:06.413 | 9 | 3 | 4 | 4 |
| 2 | 2 | 2002-04-15 10:13:06.413 | 9 | 4 | 0 | 5 |

EXAMPLE 4

Removing a Game from an Active Progressive

The central system may remove a game from a progressive game set in an active progressive. For example, the central system may remove GameID 2, which is defined as being included in ProgressiveGameSetID 1.

ProgressiveGameSet_Game

| ProgressiveGameSetID | GameID |
|---|---|
| 1 | 1 |
| 1 | 2 |
| 2 | 3 |
| 3 | 4 |

ProgressiveGameSetID 1 is, in turn, defined in ProgressiveID's 1 and 2. It is assumed in this example that ProgressiveID 2 is still active.

Progressive_ProgressiveGameSet

| ProgressiveID | ProgressiveGameSetID | ProgressiveWinningPosition |
|---|---|---|
| 1 | 1 | 1 |
| 2 | 1 | 2 |
| 2 | 2 | 1 |
| 3 | 2 | 3 |
| 3 | 3 | 3 |
| 4 | 2 | 4 |
| 5 | 3 | 0 |

The following table shows the current progressive profile used by CarouselControllerID 1 prior to removing GameID 2:

Progressive Profile for ControllerID1

| Site Controller ID | Carousel Controller ID | LastCCProgressive ProfileChange | Gaming Device ID | Game ID | Progressive Winning Position | Progressive ID |
|---|---|---|---|---|---|---|
| 1 | 1 | 2002-04-10 13:48:41.403 | 1 | 1 | 1 | 1 |
| 1 | 1 | 2002-04-10 13:48:41.403 | 2 | 1 | 1 | 1 |
| 1 | 1 | 2002-04-10 13:48:41.403 | 3 | 2 | 1 | 1 |
| 1 | 1 | 2002-04-10 13:48:41.403 | 4 | 2 | 1 | 1 |
| 1 | 1 | 2002-04-10 13:48:41.403 | 1 | 1 | 2 | 2 |
| 1 | 1 | 2002-04-10 13:48:41.403 | 2 | 1 | 2 | 2 |
| 1 | 1 | 2002-04-10 13:48:41.403 | 3 | 2 | 2 | 2 |
| 1 | 1 | 2002-04-10 13:48:41.403 | 4 | 2 | 2 | 2 |
| 1 | 1 | 2002-04-10 13:48:41.403 | 5 | 3 | 1 | 2 |
| 1 | 1 | 2002-04-10 13:48:41.403 | 6 | 3 | 1 | 2 |
| 1 | 1 | 2002-04-10 13:48:41.403 | 5 | 3 | 3 | 3 |
| 1 | 1 | 2002-04-10 13:48:41.403 | 6 | 3 | 3 | 3 |
| 1 | 1 | 2002-04-10 13:48:41.403 | 7 | 4 | 3 | 3 |
| 1 | 1 | 2002-04-10 13:48:41.403 | 8 | 4 | 3 | 3 |
| 1 | 1 | 2002-04-10 13:48:41.403 | 5 | 3 | 4 | 4 |
| 1 | 1 | 2002-04-10 13:48:41.403 | 6 | 3 | 4 | 4 |
| 1 | 1 | 2002-04-10 13:48:41.403 | 7 | 4 | 0 | 5 |
| 1 | 1 | 2002-04-10 13:48:41.403 | 8 | 4 | 0 | 5 |

GameID 2 is removed from ProgressiveGameSetID 1:

ProgressiveGameSet_Game

| ProgressiveGameSetID | GameID |
|---|---|
| 1 | 1 |
| 2 | 3 |
| 3 | 4 |

The central system sends the updated progressive profile to any affected carousel controllers (i.e., CarouselControllerID 1), which in turn notify the gaming devices in their respective control. The updated progressive profile is accompanied by the date and time of the progressive profile change. The following table shows the updated progressive profile sent to CarouselControllerID 1 after removing GameID 2:

Progressive Profile for ControllerID1

| Site Controller ID | Carousel Controller ID | LastCCProgressive ProfileChange | Gaming Device ID | Game ID | Progressive Winning Position | Progressive ID |
|---|---|---|---|---|---|---|
| 1 | 1 | 2002-04-15 10:54:53.763 | 1 | 1 | 1 | 1 |
| 1 | 1 | 2002-04-15 10:54:53.763 | 2 | 1 | 1 | 1 |
| 1 | 1 | 2002-04-15 10:54:53.763 | 1 | 1 | 2 | 2 |
| 1 | 1 | 2002-04-15 10:54:53.763 | 2 | 1 | 2 | 2 |
| 1 | 1 | 2002-04-15 10:54:53.763 | 5 | 3 | 1 | 2 |
| 1 | 1 | 2002-04-15 10:54:53.763 | 6 | 3 | 1 | 2 |
| 1 | 1 | 2002-04-15 10:54:53.763 | 5 | 3 | 3 | 3 |
| 1 | 1 | 2002-04-15 10:54:53.763 | 6 | 3 | 3 | 3 |
| 1 | 1 | 2002-04-15 10:54:53.763 | 7 | 4 | 3 | 3 |
| 1 | 1 | 2002-04-15 10:54:53.763 | 8 | 4 | 3 | 3 |
| 1 | 1 | 2002-04-15 10:54:53.763 | 5 | 3 | 4 | 4 |
| 1 | 1 | 2002-04-15 10:54:53.763 | 6 | 3 | 4 | 4 |
| 1 | 1 | 2002-04-15 10:54:53.763 | 7 | 4 | 0 | 5 |
| 1 | 1 | 2002-04-15 10:54:53.763 | 8 | 4 | 0 | 5 |

EXAMPLE 5

Enrolling a Gaming Device/Game into a Progressive

Part of the process of dynamically configuring progressives is the updating of a central system database table called "tblProgressiveUnit." This table represents a collection of the smallest physical entities in a progressive at a given point in time. A "progressive unit" is a progressive winning position within a game within a gaming device.

After this progressive unit is configured to participate in a progressive, it can further be enrolled or not enrolled within a progressive. To enroll or un-enroll a progressive unit from a progressive, an event may occur at the gaming device or at the central site. An example of a gaming device event is insertion of a player tracking card into a gaming device card reader. An example of a central site event is a decision to remove specific gaming devices from a progressive. The database table called "tblProgressiveUnit" is notified of this change, and the central system sends an updated progressive profile to any affected carousel controllers.

This example enrolls a gaming device/game entity into a progressive. In the example it is assumed that the GamingDeviceID 4/GameID 2 entity is initially un-enrolled.

tblProgressiveUnit

| Site Controller ID | Carousel Controller ID | Gaming Device ID | Game ID | Pro-gressive Winning Position | Pro-gressive ID | IsEnrolled |
|---|---|---|---|---|---|---|
| 1 | 1 | 1 | 1 | 1 | 1 | 1 |
| 1 | 1 | 2 | 1 | 1 | 1 | 1 |
| 1 | 1 | 3 | 2 | 1 | 1 | 1 |
| 1 | 1 | 4 | 2 | 1 | 1 | 0 |
| 1 | 1 | 1 | 1 | 2 | 2 | 1 |
| 1 | 1 | 2 | 1 | 2 | 2 | 1 |
| 1 | 1 | 3 | 2 | 2 | 2 | 1 |
| 1 | 1 | 4 | 2 | 2 | 2 | 0 |
| 1 | 1 | 5 | 3 | 1 | 2 | 1 |
| 1 | 1 | 6 | 3 | 1 | 2 | 1 |
| 1 | 1 | 5 | 3 | 3 | 3 | 1 |
| 1 | 1 | 6 | 3 | 3 | 3 | 1 |
| 1 | 1 | 7 | 4 | 3 | 3 | 1 |
| 1 | 1 | 8 | 4 | 3 | 3 | 1 |
| 1 | 1 | 5 | 3 | 4 | 4 | 1 |
| 1 | 1 | 6 | 3 | 4 | 4 | 1 |
| 1 | 1 | 7 | 4 | 0 | 5 | 1 |
| 1 | 1 | 8 | 4 | 0 | 5 | 1 |
| 2 | 2 | 9 | 3 | 1 | 2 | 1 |
| 2 | 2 | 9 | 3 | 4 | 4 | 1 |
| 2 | 2 | 9 | 3 | 4 | 4 | 1 |
| 2 | 2 | 9 | 4 | 0 | 5 | 1 |

The following table shows the current progressive profile used by CarouselControllerID 1 prior to enrolling the GamingDeviceID 4/GameID 2 entity:

Progressive Profile for ControllerID1

| Site Controller ID | Carousel Controller ID | LastCCProgressive ProfileChange | Gaming Device ID | Game ID | Progressive Winning Position | Progressive ID |
|---|---|---|---|---|---|---|
| 1 | 1 | 2002-04-10 13:48:41.403 | 1 | 1 | 1 | 1 |
| 1 | 1 | 2002-04-10 13:48:41.403 | 2 | 1 | 1 | 1 |
| 1 | 1 | 2002-04-10 13:48:41.403 | 3 | 2 | 1 | 1 |
| 1 | 1 | 2002-04-10 13:48:41.403 | 1 | 1 | 2 | 2 |
| 1 | 1 | 2002-04-10 13:48:41.403 | 2 | 1 | 2 | 2 |
| 1 | 1 | 2002-04-10 13:48:41.403 | 3 | 2 | 2 | 2 |
| 1 | 1 | 2002-04-10 13:48:41.403 | 5 | 3 | 1 | 2 |
| 1 | 1 | 2002-04-10 13:48:41.403 | 6 | 3 | 1 | 2 |
| 1 | 1 | 2002-04-10 13:48:41.403 | 5 | 3 | 3 | 3 |
| 1 | 1 | 2002-04-10 13:48:41.403 | 6 | 3 | 3 | 3 |
| 1 | 1 | 2002-04-10 13:48:41.403 | 7 | 4 | 3 | 3 |
| 1 | 1 | 2002-04-10 13:48:41.403 | 8 | 4 | 3 | 3 |
| 1 | 1 | 2002-04-10 13:48:41.403 | 5 | 3 | 4 | 4 |
| 1 | 1 | 2002-04-10 13:48:41.403 | 6 | 3 | 4 | 4 |
| 1 | 1 | 2002-04-10 13:48:41.403 | 7 | 4 | 0 | 5 |
| 1 | 1 | 2002-04-10 13:48:41.403 | 8 | 4 | 0 | 5 |

An event occurs to enroll the GamingDeviceID 4/GameID 2 entity.

tblProgressiveUnit

| Site Controller ID | Carousel Controller ID | Gamine Device ID | Game ID | Pro-gressive Winning Position | Pro-gressive ID | IsEnrolled |
|---|---|---|---|---|---|---|
| 1 | 1 | 1 | 1 | 1 | 1 | 1 |
| 1 | 1 | 2 | 1 | 1 | 1 | 1 |
| 1 | 1 | 3 | 2 | 1 | 1 | 1 |
| 1 | 1 | 4 | 2 | 1 | 1 | 1 |
| 1 | 1 | 1 | 1 | 2 | 2 | 1 |
| 1 | 1 | 2 | 1 | 2 | 2 | 1 |
| 1 | 1 | 3 | 2 | 2 | 2 | 1 |
| 1 | 1 | 4 | 2 | 2 | 2 | 1 |
| 1 | 1 | 5 | 3 | 1 | 2 | 1 |
| 1 | 1 | 6 | 3 | 1 | 2 | 1 |
| 1 | 1 | 5 | 3 | 3 | 3 | 1 |
| 1 | 1 | 6 | 3 | 3 | 3 | 1 |
| 1 | 1 | 7 | 4 | 3 | 3 | 1 |
| 1 | 1 | 8 | 4 | 3 | 3 | 1 |
| 1 | 1 | 5 | 3 | 4 | 4 | 1 |
| 1 | 1 | 6 | 3 | 4 | 4 | 1 |
| 1 | 1 | 7 | 4 | 0 | 5 | 1 |
| 1 | 1 | 8 | 4 | 0 | 5 | 1 |
| 2 | 2 | 9 | 3 | 1 | 2 | 1 |
| 2 | 2 | 9 | 3 | 4 | 4 | 1 |
| 2 | 2 | 9 | 4 | 0 | 5 | 1 |

The following table shows the updated progressive profile sent to CarouselControllerID 1 after enrolling the GamingDeviceID 4/GameID 2 entity:

Progressive Profile for ControllerID1

| Site Controller ID | Carousel Controller ID | LastCCProgressive ProfileChange | Gaming Device ID | Game ID | Progressive Winning Position | Progressive ID |
|---|---|---|---|---|---|---|
| 1 | 1 | 2002-04-15 11:04:31.591 | 1 | 1 | 1 | 1 |
| 1 | 1 | 2002-04-15 11:04:31.591 | 2 | 1 | 1 | 1 |
| 1 | 1 | 2002-04-15 11:04:31.591 | 3 | 2 | 1 | 1 |
| 1 | 1 | 2002-04-15 11:04:31.591 | 4 | 2 | 1 | 1 |
| 1 | 1 | 2002-04-15 11:04:31.591 | 1 | 1 | 2 | 2 |
| 1 | 1 | 2002-04-15 11:04:31.591 | 2 | 1 | 2 | 2 |
| 1 | 1 | 2002-04-15 11:04:31.591 | 3 | 2 | 2 | 2 |
| 1 | 1 | 2002-04-15 11:04:31.591 | 4 | 2 | 2 | 2 |
| 1 | 1 | 2002-04-15 11:04:31.591 | 5 | 3 | 1 | 2 |
| 1 | 1 | 2002-04-15 11:04:31.591 | 6 | 3 | 1 | 2 |
| 1 | 1 | 2002-04-15 11:04:31.591 | 5 | 3 | 3 | 3 |
| 1 | 1 | 2002-04-15 11:04:31.591 | 6 | 3 | 3 | 3 |
| 1 | 1 | 2002-04-15 11:04:31.591 | 7 | 4 | 3 | 3 |
| 1 | 1 | 2002-04-15 11:04:31.591 | 8 | 4 | 3 | 3 |
| 1 | 1 | 2002-04-15 11:04:31.591 | 5 | 3 | 4 | 4 |
| 1 | 1 | 2002-04-15 11:04:31.591 | 6 | 3 | 4 | 4 |
| 1 | 1 | 2002-04-15 11:04:31.591 | 7 | 4 | 0 | 5 |
| 1 | 1 | 2002-04-15 11:04:31.591 | 8 | 4 | 0 | 5 |

The present invention employs a database application at the central system to dynamically define and propagate progressives. With this capability of enabling and disabling the progressive nature of a game, the variations of progressive configuration are expanded. The present invention allows an upstream piece of software (e.g., carousel controller) to logically associate progressive definitions to events generated from the game and to control the game's progressive behavior. Furthermore, the present invention layers application configuration onto physical configuration. With a secure and well-monitored common physical configuration for each game within each gaming device, multiple application configurations can be associated to each element of the physical definition. This, in turn, allows modular growth into a suite of applications that may or may not be participating on the game. The similarity of database schema across multiple central systems allows for easy data replication to an overall central analysis server.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims:

What is claimed is:

1. A gaming system comprising:

a plurality of common objects shared by a plurality of applications, the plurality of common objects including gaming devices and games, each gaming device including at least one of the games;

a plurality of application objects used in one of the applications; and a central system linked to the gaming devices, the central system including a common database and an application database, the common database defining the common objects and first associations between the common objects, the application database defining the application objects, second associations between the application objects, and third associations between the common objects and the application objects, the central system being adapted to dynamically configure the one of the applications based on a change to one or more of the first, second, and third associations.

2. The system of claim 1, wherein the plurality of common objects include a site controller for managing a remote site where at least some of the gaming devices are located.

3. The system of claim 2, wherein the plurality of common objects include a plurality of carousel controllers at the remote site, wherein the gaming devices at the remote site are arranged in a plurality of carousels managed by the respective carousel controllers, the carousel controllers being managed by the site controller.

4. The system of claim 1, wherein the plurality of application objects are progressive objects used in a progressive gaming application.

5. The system of claim 4, wherein the progressive objects include progressive game sets, progressives, and progressive winning positions.

6. The system of claim 1, wherein each of the plurality of common objects and each of the plurality of application objects are each identified by a unique identifier assigned by the central system.

7. The system of claim 1, wherein the central system generates application profiles used by one or more of the common objects.

8. The system of claim 7, wherein the application profile of an affected common object is updated based on the change to the one or more of the first, second, and third associations.

9. The system of claim 8, wherein the central system transmits the updated application profile to the affected common object, and the affected common object notifies any of the gaming devices in its control of the updated application profile.

10. The system of claim 8, wherein the updated progressive profile is accompanied by a date and time at which the application profile was updated.

11. A method of dynamically configuring a gaming system comprising:

providing a plurality of common objects shared by a plurality of applications, the plurality of common objects including gaming devices and games, each gaming device including at least one of the games;

providing a plurality of application objects used in one of the applications;

linking a central system to the plurality of gaming devices;

defining the common objects and first associations between the common objects in a common database in the central system;

defining the application objects, second associations between the application objects, and third associations between the common objects and the application objects in an application database in the central system; and using the central system to dynamically configure the one of the applications based on a change to one or more of the first, second, and third associations.

12. The method of claim 11, wherein the plurality of common objects include a site controller for managing a remote site where at least some of the gaming devices are located.

13. The method of claim 12, wherein the plurality of common objects include a plurality of carousel controllers at the remote site, wherein the gaming devices at the remote site are arranged in a plurality of carousels managed by the respective carousel controllers, the carousel controllers being managed by the site controller.

14. The method of claim 11, wherein the plurality of application objects are progressive objects used in a progressive gaming application.

15. The method of claim 14, wherein the progressive objects include progressive game sets, progressives, and progressive winning positions.

16. The method of claim 11, further including assigning, at the central system, a unique identifier to each of the common objects and each of the application objects.

17. The method of claim 11, further including generating, at the central system, application profiles used by one or more of the common objects.

18. The method of claim 17, wherein the step of using the central system to dynamically configure the one of the applications includes updating the application profile of an affected common object based on the change to the one or more of the first, second, and third associations.

19. The method of claim 18, wherein the step of using the central system to dynamically configure the one of the applications includes transmitting the updated application profile from the central system to the affected common object, the affected common object notifying any of the gaming devices in its control of the updated application profile.

20. The method of claim 18, wherein the updated progressive profile is accompanied by a date and time at which the application profile was updated.

* * * * *